US007188493B2

(12) United States Patent
Conway

(10) Patent No.: US 7,188,493 B2
(45) Date of Patent: Mar. 13, 2007

(54) JEWELRY FOR RECEIVING RINGS

(76) Inventor: Mary Conway, 2331 Saybrook Rd., University Heights, OH (US) 44118-3707

( * ) Notice: Subject to any disclaimer, the term of this patent is extended or adjusted under 35 U.S.C. 154(b) by 0 days.

(21) Appl. No.: 10/340,050

(22) Filed: Jan. 10, 2003

(65) Prior Publication Data

US 2003/0126887 A1 Jul. 10, 2003

Related U.S. Application Data

(60) Provisional application No. 60/347,660, filed on Jan. 10, 2002.

(51) Int. Cl.
*A44C 25/00* (2006.01)

(52) U.S. Cl. ..... 63/1.18; 63/3; 63/4; 206/6.1; 224/604

(58) Field of Classification Search ..... 63/1.11, 63/1.16, 1.17, 1.18, 13, 18, 19, 3.2, 23, 4, 63/33, 40, 1.14, 21, 35; 224/255, 257, 268, 224/101, 185, 576, 577, 191, 197, 603, 604; 206/6.1, 37; D3/903; D11/3, 26
See application file for complete search history.

(56) References Cited

U.S. PATENT DOCUMENTS 509,888 A * 12/1893 Gaynor ..... 63/23
509,889 A * 12/1893 Gaynor ..... 63/23
1,590,172 A * 6/1926 Thorberg ..... 24/3.1
2,506,800 A * 5/1950 Maclennan ..... 250/464.1
2,650,445 A * 9/1953 Randall ..... 428/3
2,665,042 A * 1/1954 Starolis ..... 224/255
D177,881 S * 5/1956 St. Mary ..... D11/89
3,552,119 A 1/1971 Newman et al.
3,718,260 A * 2/1973 Sharp ..... 211/85.2
4,165,621 A * 8/1979 Gould ..... 63/1.11
4,265,098 A 5/1981 Wayne
4,305,262 A 12/1981 Ferrara
D272,609 S 2/1984 Ofiesh, II
D278,520 S 4/1985 Hamtak
D278,609 S 4/1985 Satterelli
4,516,708 A * 5/1985 Elliott ..... 224/257
4,632,351 A * 12/1986 Coon ..... 248/309.2
4,879,882 A * 11/1989 Johnson et al. ..... 63/4
5,758,516 A * 6/1998 Uematsu ..... 63/23
5,974,830 A * 11/1999 Colero ..... 63/26

(Continued)

*Primary Examiner*—Jack W. Lavinder
(74) *Attorney, Agent, or Firm*—Fay Sharpe LLP

(57) ABSTRACT

An improved jewelry provides a body having an enlarged dimension at one end that prevents a ring from sliding off the body and a smaller dimension at a second end that readily receives the ring thereover. A chain is provided at the first end so that the body and chain with the ring forms a bracelet or necklace and the chain simultaneously secures the ring from inadvertent removal over the second end. The body can adopt a wide variety of conformations and configurations such as solid, hollow, tapered, discontinuous, and the chain can be secured through an opening that passes through the body or a separate eyelet or hook that forms an opening is provided at the first end to allow the ring to be advanced over the body before the chain is secured thereto. The body likewise can be formed of various materials such as precious metals, ceramic, plastic, porcelain, gem stone, shell, stone, or wood and/or the body may be unadorned or can be ornamented with etchings, gem stones, engraving, surface texture, color, etc.

13 Claims, 2 Drawing Sheets

U.S. PATENT DOCUMENTS 6,116,053 A * 9/2000 Siebenberg ..... 63/15
6,209,351 B1 * 4/2001 Zeleny ..... 63/1.16
6,490,885 B1 * 12/2002 Wilkinson ..... 63/1.11

* cited by examiner

JEWELRY FOR RECEIVING RINGS

This application hereby incorporates by reference and claims priority from U.S. Provisional Application Ser. No. 60/347,660, filed Jan. 10, 2002.

BACKGROUND OF THE INVENTION

This invention relates to jewelry, particularly a necklace, string, or chain worn around a user's neck. More particularly, the jewelry easily and effectively secures a ring in an aesthetically pleasing manner.

Rings are a very popular form of jewelry. On occasion, however, rings must be removed from a person's finger. For example, an occupation or job, medical condition, etc. may warrant that a user remove the ring from their finger. Some people simply prefer not to wear any rings on their hands. Still others do not desire to re-size a ring and still wish to wear the ring in a decorative manner.

Some people desire an alternative manner of ring display. For example, U.S. Pat. No. 4,305,262 teaches a necklace having an elongated bar on which gems or mounts are selectively mounted, and to which additional gems may be added. The gem mount requires use of a split sleeve or split ring to add additional gem mounts to the jewelry. Thus, the gem mount can be alternatively worn in the form of a bracelet or necklace, depending on the length of the chain. Opposite ends of the chain use a conventional spring closure or connector, although different types of connectors such as clasps, hooks, and the like may be employed to interconnect the ends of the chain together. To custom mount one or more gem mounts to the bar, the split sleeve is spread apart and placed over the bar. The split sleeve is subsequently squeezed together or deformed to secure the gem mount on the bar.

Unfortunately, the arrangement described in this prior art patent requires the split ring arrangement and does not accommodate a complete annulus or ring. Although it is envisioned that an enlarged ring could slide over an end of the chain, no means is then available to hold the ring in place. Accordingly, a need exists for a simple, economical, and easy-to-use arrangement that mounts one or more rings onto a bracelet or a necklace arrangement is thus desired or required.

A conventional ring mandrel is used by jewelers to measure ring size. The ring mandrel includes markings periodically spaced along an external surface of the mandrel (i.e., a gauge) from a narrow first end to an enlarged second end. When the ring is placed over the narrow end, it stops along the tapered diameter thereby allowing the jeweler to easily read the gauge and determine the size of the ring. However, that is the only known use of the ring mandrel. Ring-holding displays are similar in shape but they are specifically instruments to hold and display the ring(s) and do not address the deficiencies noted above.

BRIEF SUMMARY OF THE INVENTION

An improved jewelry provides a body having an enlarged dimension at one end that prevents a ring from sliding off the body and a smaller dimension at a second end that readily receives the ring thereover. Means is provided between the ends to receive a chain that forms the bracelet or necklace and simultaneously secures the ring from inadvertent removal over the second end.

A preferred embodiment of the invention includes a tapered body having an opening formed through the body between the first and second ends. The opening is dimensioned to receive a chain or string therethrough. The string or chain is fed through the opening subsequent to insertion of the ring onto the body.

In accordance with another embodiment of the invention, the chain opening is located approximately one-third of the dimension from the first end to the second end so that the ring is securely held on the body.

According to another embodiment, the body may be solid, flared, hollow, or of various shapes and configurations that retain the ring at one end of the body and the chain retains the ring at the other end.

According to a preferred method, a ring is advanced over a narrow end of the body. The method includes the further step of securing a chain through the first end of the body subsequent to placing the ring on the body to maintain the ring in place.

DETAILED DESCRIPTION OF THE INVENTION

Figure 1:
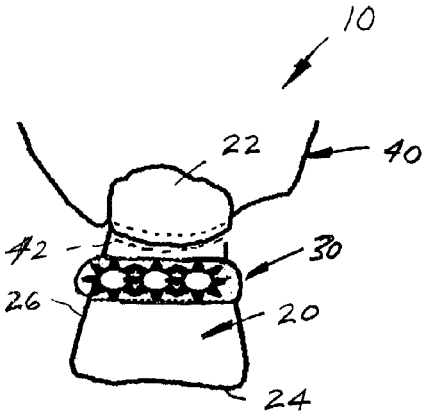
FIG. 1 is a plan view of a first embodiment of the invention.

Turning first to FIG. 1, jewelry 10 formed in accordance with the present invention is illustrated. It includes a body 20 having a first portion or narrowed end 22 and a second portion or enlarged end 24. In this embodiment, the body has a tapered configuration in which sidewall 26 has a constant, gradual taper as it extends from the narrowed dimension, first end to the enlarged dimension, second end 24. Although this is illustrated as a constant progressive taper that increases in diameter over its length, other conformations can be used without departing from the scope and intent of the invention. For example, the body can flare outwardly at one end such as a trumpet-shape, or have an hour-glass conformation in which the first end is smaller in cross-section than the second end and the middle portion is even smaller in diameter, or the body may have a constant dimension throughout a portion of its length and then taper or enlarge to an enlarged dimension along another portion of its length.

A ring 30 is received on the body. Specifically, the ring has an inner dimension (diameter) less than the enlarged second end 24 of the body. In addition, the inner opening of the ring is larger than that of the narrowed first end 22 of the body. In this manner, the ring is advanced over the body by passing over the narrowed first end but cannot fall off the body or pass over the second end.

Once the ring is positioned over the body, a chain 40 is subsequently fed through an opening 42 in the body. When the chain is worn around the neck of the wearer, the chain prevents the ring from being removed over the narrowed first end. In addition, the tapered conformation of the body is preferred since it orients the body for display purposes. That is, the second end is likely heavier and naturally orients itself toward the ground. In addition, the opening 42 that receives the chain is preferably disposed closer to the first, narrowed end, e.g., approximately one-third of the way from the first end and two-thirds of the way from the second end. This, too, contributes to the natural hanging of the body and effective display of the ornamental ring.

Figure 2:
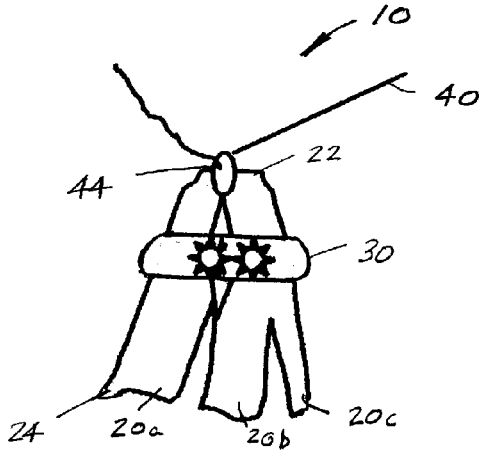
FIG. 2 is a plan view of a second embodiment of the invention.

The body 24 is a solid body in a first preferred embodiment or may adopt a hollow configuration, for example as shown in FIG. 2. In FIG. 2, the body is comprised of a set of tapered fingers 20*a*, 20*b*, 20*c*, that diverge from one another as the fingers extend from an interconnected first end 22 to the opened, enlarged end 24. In this embodiment, the opening is represented by numeral 44 and is formed as an eyelet, hook, clasp, or loop at the first end. The opening is dimensioned to receive the chain 40 therethrough and does not adversely impact on mounting of the ring over the narrowed first end 22. It will also be appreciated, that the body may be a hollow, tapered cylinder without individual finger portions. Still other configurations that achieve these same objectives in a structurally equivalent manner are intended to be encompassed within the present invention.

Figure 3:
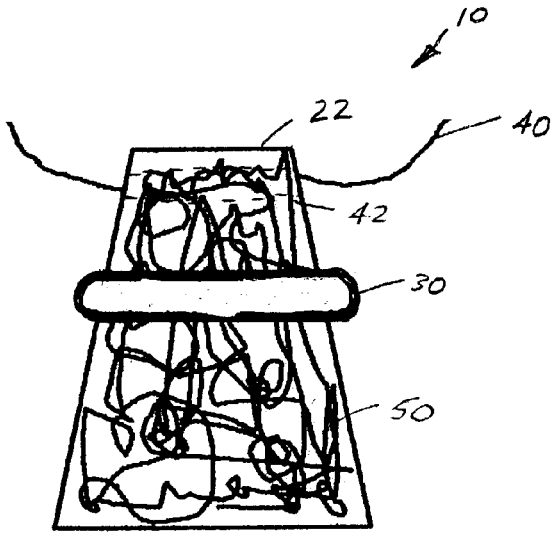
FIG. 3 is a plan view of a third embodiment of the invention.

FIG. 3 demonstrates that the body can also be suitably ornamental. For example, gems, engravings, etchings, color, surface texture, etc. can be provided on the body as represented by reference numeral 50.

Figure 4:
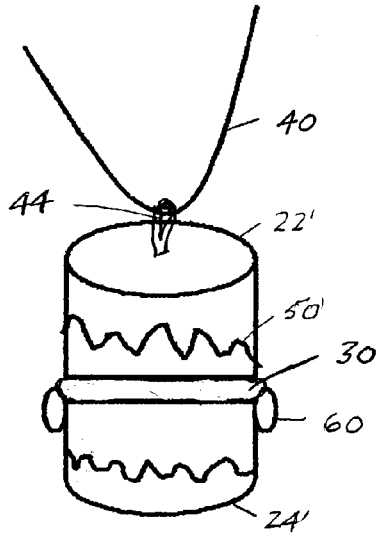
FIG. 4 is a plan view of a fourth embodiment of the invention.

FIG. 4 more particularly illustrates that the body need not necessarily have a tapered shape. Here, stop member 60 is provided on a generally cylindrical body. That is, the first end 22' and second end 24' are substantially identical in dimension. Since the ring has an inner opening adapted for receipt over the first end 22', an alternative means for retaining the ring on the body is required. Stop member 60 serves this purpose. It is preferably located more adjacent the second end 24', but can be located at various locations as will be appreciated. Thus, the term "end" does not necessarily require the narrow or enlarged dimension to be located at a terminal end of the body. In the FIG. 4 embodiment, the chain is received through a hook opening 44 that extends axially outward from the body and does not impact on the cross-sectional dimension of the first end, similar to that employed in FIG. 2. Thus, the ring has an inner dimension that is still advanced over the narrow dimension defined at the first end 22' and retained at that end once the chain 40 is inserted through the opening 44. The ring is maintained at the second end by contacting the stop member 60. Stop member 60 has an enlarged dimension relative to the inner opening through the ring.

Figure 5:
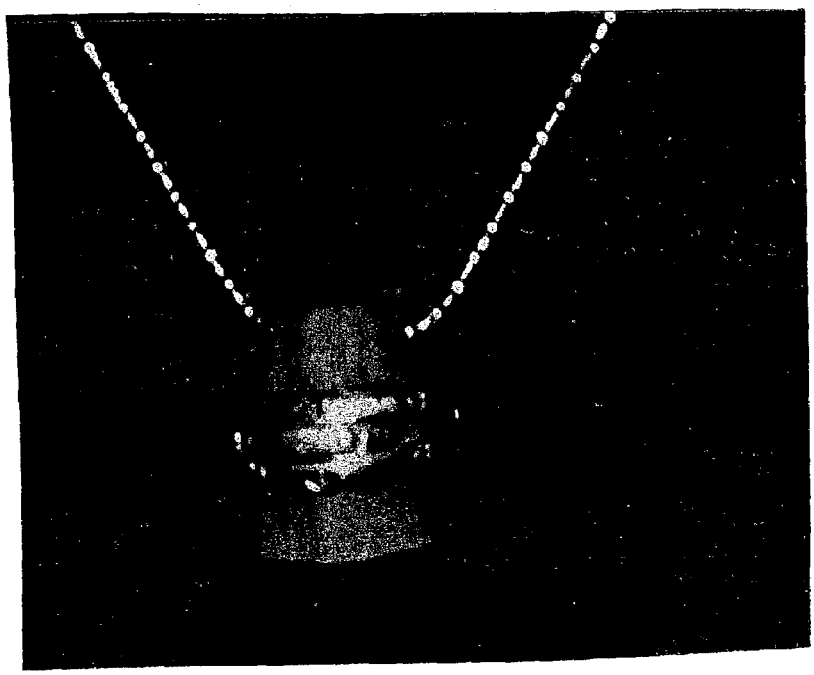
FIG. 5 is a photograph of the present invention.
Figure 6:
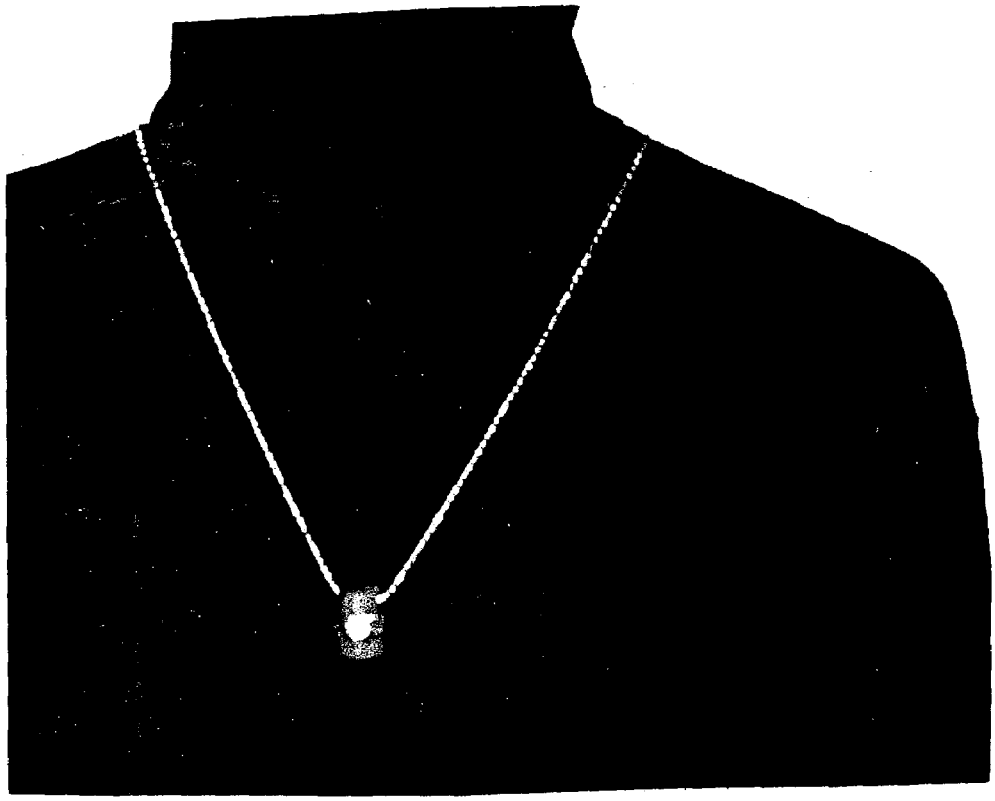
FIG. 6 is a photograph illustrating how the invention is worn around the neck of a user.

FIG. 5 is a photograph of a prototype, and FIG. 6 is likewise a photograph illustrating how the jewelry is worn about the neck of a user.

It will be appreciated that a number of modifications can be made to the invention. For example, the chain 40 can be a string or chain made of various material, such as leather, metal, plastic, ribbon, string, yarn, etc. The body may be a solid piece, flared piece of multi-section, partial pieces, hollow, may incorporate a body compartment or a tubular piece, or a body having various cross-sectional dimensions or conformations such as a square, rectangle, triangle, cone, etc. The body likewise can be formed of various materials. Precious metals, ceramic, plastic, porcelain, gem stone, shell, stone, or wood are representative materials, but should not be deemed as limiting. As noted above, the body may be unadorned or can be ornamented with etchings, gem stones, engraving, surface texture, color, etc.

It will also be appreciated that the body can come in various sizes to accommodate different size rings. For example, a size "5" ring is matched with a size "5" body that allows the ring to be advanced over the first end and held in place by the enlarged dimension adjacent the second end. Although the opening or loop that receives the chain is more closely disposed adjacent the first end of the body, it will also be appreciated that different configurations or location of the opening are also contemplated without departing from the scope and intention of the present invention.

Having thus described the invention, it is now claimed:

1. An improved jewelry assembly for displaying ring comprising:

a body having an unthreaded, generally smooth outer surface, a smaller dimension adjacent a first end and an enlarged dimension adjacent a second end, and an opening formed through the body interposed between the first and second ends of the body;

a ring having an opening dimension for receipt over the first end of the body and precluding receipt over the second end of the body; and a chain separate from the ring that is received through the body opening between the ring and the body first end and prevents the ring from inadvertent removal over the first end of the body when the chain is worn around an associated user's neck.

2. The invention of claim 1 wherein the body is tapered from the first end to the second end.

3. The invention of claim 1 wherein the chain opening is located approximately one-third of a dimension from the first end to the second end so that the ring is held on the body.

4. The invention of claim 1 wherein the body is solid.

5. The invention of claim 1 wherein the body is hollow.

6. The invention of claim 1 wherein the enlarged dimension adjacent the second end is defined by a stop member on the body.

7. A method of securing a jewelry ring having an opening therethrough for wearing as one of a necklace and bracelet comprising the steps of:

providing a necklace/bracelet body having an unthreaded, generally smooth outer surface having first and second ends with different cross-sectional dimensions, the cross-sectional dimension of the first end being less than the cross-sectional dimension of the second end and less than a diameter of the ring opening, and the cross-sectional dimension of the second end being greater than the ring opening diameter, and an opening through the necklace/bracelet body adjacent the first end;

advancing the ring over the first end of the necklace/bracelet body; and securing a chain to the first end of the necklace/bracelet body through the opening without securing the chain to the ring, subsequent to advancing the ring on the necklace/bracelet body to maintain the ring on the necklace/bracelet body between the first and second ends when the chain is received around a user's neck.

8. In combination, an improved jewelry assembly comprising:

a ring having a smooth inner surface;

a body having an unthreaded, generally smooth outer surface, a smaller dimension adjacent a first end that readily receives the ring thereover and an enlarged dimension adjacent a second end that prevents the ring from sliding off the body over the second end, said body having a generally tapered configuration between the first end and the second end; and means interposed between the first and second ends of the body for receiving a chain therethrough without passing through the ring once the ring is secured to the body and that prevents the ring from inadvertent removal over the first end of the body when the chain is received around a user's neck.

9. The invention of claim 8 wherein the body is tapered from the first end to the second end.

10. The invention of claim 8 wherein the receiving means is an opening formed through the body between the first and second ends dimensioned to receive the chain therethrough.

11. The invention of claim 10 wherein the chain opening is located approximately one-third of a dimension from the first end to the second end so that the associated ring is held on the body.

12. The invention of claim 8 wherein the body is solid.

13. The invention of claim 8 wherein the body is hollow.

* * * * *